US006672919B1

(12) United States Patent
Beson

(10) Patent No.: US 6,672,919 B1
(45) Date of Patent: Jan. 6, 2004

(54) TEMPERATURE CONTROL SYSTEM FOR MARINE EXHAUST

(76) Inventor: Thomas William Beson, 1000 Third St., #A5, Menasha, WI (US) 54952

( * ) Notice: Subject to any disclaimer, the term of this patent is extended or adjusted under 35 U.S.C. 154(b) by 0 days.

(21) Appl. No.: 10/272,684

(22) Filed: Oct. 17, 2002

Related U.S. Application Data

(60) Provisional application No. 60/417,580, filed on Oct. 9, 2002, and provisional application No. 60/418,059, filed on Oct. 11, 2002.

(51) Int. Cl.[7] ..... B63H 21/32

(52) U.S. Cl. ..... 440/89 R; 440/88 R; 60/312; 123/41.08; 123/41.44

(58) Field of Search ..... 440/1, 88 N, 88 R, 440/89 R; 60/312, 314; 123/41.08, 41.44; 165/41

(56) References Cited

U.S. PATENT DOCUMENTS

| | | | | | |
|---|---|---|---|---|---|
| 2,350,598 | A | | 6/1944 | Faville | 257/1 |
| 3,137,281 | A | | 6/1964 | Fulker | 123/41.02 |
| 4,457,727 | A | | 7/1984 | Flaig | 440/88 |
| 4,728,306 | A | | 3/1988 | Schneider | 440/1 |
| 5,531,619 | A | * | 7/1996 | Nakase et al. | 440/1 |
| 5,531,620 | A | | 7/1996 | Ozawa et al. | 440/89 |
| 5,637,792 | A | * | 6/1997 | Kimura et al. | 73/116 |
| 5,746,054 | A | | 5/1998 | Matte | 60/310 |
| 5,746,270 | A | * | 5/1998 | Schroeder et al. | 165/41 |
| 5,788,547 | A | | 8/1998 | Ozawa et al. | 440/89 |
| 5,937,802 | A | | 8/1999 | Bethel et al. | 123/41.74 |
| 5,983,633 | A | * | 11/1999 | Woleslagle et al. | 60/312 |
| 6,261,140 | B1 | * | 7/2001 | Yoshida et al. | 440/88 R |
| 6,315,624 | B1 | * | 11/2001 | Tetzlaff et al. | 440/89 R |
| 6,368,169 | B1 | * | 4/2002 | Jaeger | 440/88 R |
| 6,406,344 | B1 | * | 6/2002 | Bland et al. | 440/88 R |

* cited by examiner

*Primary Examiner*—S. Joseph Morano
*Assistant Examiner*—Lars A. Olson
(74) *Attorney, Agent, or Firm*—Wilhelm Law Service; Thomas D. Wilhelm

(57) ABSTRACT

Temperature control system for marine engine exhaust system. The control system lowers flow of cooling water to water jacket and exhaust gas conduit of the exhaust system at low engine speeds. The control system is typically activated at and below a predetermined engine speed. Once activated, the control system operates to reduce flow of cooling water to the exhaust system. The control can operate in an on/off mode, or can modulate rate of flow of water through the exhaust system, or both. However the water flow is limited, a predetermined minimum flow of cooling water is maintained through the exhaust system, at least either at periodic intervals, or at a constant but lowered rate, to maintain cooling in the exhaust system on rubber components of the exhaust system.

69 Claims, 4 Drawing Sheets

TEMPERATURE CONTROL SYSTEM FOR MARINE EXHAUST

BACKGROUND

Under certain operating conditions, mostly at or near idle engine speed, in a four cycle reciprocating marine engine, liquid water can run backward in the marine exhaust system, whereby liquid water flows backward from the exhaust system into the engine cylinders.

Specifically, the invention addresses such marine engine/exhaust assemblies wherein cooling water flows through a water jacket in the exhaust system, to quickly cool the exhaust gases soon after the exhaust gases leave the engine exhaust ports. Typically, such cooling water is directed through a water jacket on the exhaust manifold, or whatever other structure first receives the exhaust gases from the engine. After circulating through the water jacket, the cooling water is injected into the exhaust gas stream, downstream from the water jacket.

Such injected water mixes with the exhaust gases, thus to further cool the exhaust gases. The mixture of exhaust gases and water then travel together to the exit of the exhaust system. The primary reason for mixing the liquid water with the exhaust gases is to cool the exhaust gases sufficiently that rubber components of the exhaust system not be damaged by the exhaust gases.

A first source of the condensed liquid water of concern is the hot exhaust gas which comes into contact with a colder surface of the metal exhaust manifold, where the metal exhaust manifold has a temperature cold enough to condense water vapor out of the exhaust gases. Water vapor, which is a primary component of the engine exhaust gases, condenses out of the exhaust gases onto the exhaust manifold walls, flows downwardly, and accumulates on a lower surface of the exhaust manifold. In some instances, such condensation takes place downstream of the exhaust manifold, in an exhaust pipe, wherein the condensed liquid water accumulates on a lower surface of the exhaust pipe.

A second source of water accumulation on a lower surface of the exhaust manifold or exhaust pipe is based on a phenomenon known as reversion. Reversion occurs when, in operation of the intake valves and the exhaust valves, both an intake valve and an exhaust valve are momentarily open at the same time. Specifically, the engine/exhaust combination is most susceptible to reversion when a piston is positioned between near and approaching top dead center, and near and just after top dead center, during the transition from the upward exhaust cycle to the downward intake cycle. This momentary valve-timing occurrence is known as valve overlap.

When valve overlap occurs, the high negative pressure of the intake plenum can cause the direction of flow of exhaust gases in the exhaust manifold and the down stream exhaust conduit pipe to momentarily be reversed. This reverse direction of flow of exhaust gases, known as reversion, can carry with it any of the liquid cooling water which is injected into the exhaust gas stream. The reverse direction flow of exhaust gases can cause the injected liquid water to be pulled, or walked backward, into the exhaust manifold or other water-jacketed exhaust system component. After a period of operation under such reverse direction flow conditions, this water can accumulate on the floor or other lower surface of the respective exhaust system component.

When this water, either exhaust gas condensate, or reversion in injected water, or both, accumulates in quantity large enough to flow backward into an engine cylinder at the respective exhaust port, either by gravity or by further operation of reverse exhaust gas flow of the reversion process, such flow does occur, whereby the liquid water flows back into a respective cylinder.

When the liquid water, which is essentially incompressible, flows into the engine cylinder in sufficient quantity, the piston is prevented from moving through the compression stroke when the piston reduces the cylinder volume to essentially the volume of the water in the cylinder, before the piston completes the compression stroke. When that happens, the engine is stopped dead. The engine cannot turn further because completion of the compression stroke of the piston requires further reduction of the space in the cylinder, but the liquid water in the cylinder cannot compress and there is no path by which the water can quickly escape. Thus, the piston movement is blocked by the incompressible water. While the water can be removed by removing the spark plug, the only full cure for the water in the cylinder is to disassemble the engine in order to repair the damage done by the water.

Even if the quantity of water entering the engine is not great enough to stop the engine from running, such water ingestion can cause other problems. For example, any quantity of liquid water in the engine can cause corrosion. In addition, under certain conditions, the water can, over time, leak past the piston rings, and thereby enter the underlying oil reservoir, commonly known as the lubricating oil reservoir, or the oil crank case. In the crank case, the water becomes entrained with the engine lubricating oil, and is thus distributed throughout the engine as the oil is pumped through the oil passages, and onto all parts which are lubricated by the oil. The presence of the water in such loci, even though carried by oil, works to initiate corrosion in respective ones of the engine parts and areas so exposed to the water.

The resulting corrosion can occur throughout all areas, and in all parts, of the engine to which the oil flows because all the contaminated oil, which is pumped to all areas of the engine, is contaminated. The most predominant place for corrosion to occur is on the cylinder walls, which is the first area to see the ingested water. In some instances, the corrosion can become severe enough to cause engine components, which are supposed to slide with respect to each other, to freeze together. The greatest risk of corrosion, and the most rapid spread of corrosion, typically occur where the boat is being used in salt water, whereby salt water is being used as the cooling water.

The condensation portion of the above described problem occurs in all internal combustion reciprocating engines when a given engine is cold. For engines which are not used in a marine application, when the engine starts operating, the heat of the exhaust gases rapidly heats up the walls of the exhaust conduit system to the point where water vapor stops condensing, and any already-condensed water is either evaporated and carried out of the exhaust system as vapor, or the liquid water is physically entrained in the exhaust gases by the force of flow of the exhaust gases. Such non-marine engine/exhaust assemblies are so exposed to ambient air that heat build-up is of less concern, and since cooling water is not so available as in a boat, such water-jacketed exhaust systems are typically not used, whereby condensate and reversion in the exhaust system, near the engine, typically do not occur.

The phenomenon of condensed water leaving the exhaust system can be observed in colder climates in non-marine applications where, for a short period after an engine is started, water can be seen dripping out of the tailpipe of the exhaust system. The liquid water stops dripping after a short period of running time as the exhaust system heats up and maintains the exhaust gas water vapor, in the vapor state.

The problem of condensed, liquid water entering the engine block through the exhaust ports, and thereby causing engine damage or engine failure is generally confined to marine engines where cooling water is necessarily used to cool the exhaust system. Namely, fresh or salt sea water, depending on the body of water involved, is pumped through water jackets which surround the exhaust pipes which carry exhaust gases away from the engine. Typically, after the sea water traverses the water jacket, that same sea water is injected into the exhaust gas flow stream in the main exhaust-carrying conduit or chamber of the exhaust pipe. Thus, in the exhaust system, the sea water first passes through a water jacket which extends around the exhaust pipe, or through a water jacket which is associated with an exhaust manifold, or both, relatively closer to the engine, and then passes from the water jacket into the exhaust gas flow stream in the main gas flow conduit or chamber of the exhaust pipe, downstream of the water jacket end portion of the exhaust system.

Without such water cooling, both in the jacket and in the exhaust gas stream, the engine enclosing compartment would overheat to the extent of creating a fire hazard in the engine compartment. In addition, without such cooling, the ambient temperature within the engine compartment would be elevated to the point where the heated ambient air, which would be ingested into the engine, would prevent the engine from developing rated power and could result in premature engine component wear due to overheating.

The advantage obtained by using water jacket cooling at high power output becomes a disadvantage, indeed a detriment, at low power output of such engines such as when the engine is run at idle speeds; for substantial periods of time, for example to get from open water to a mooring, or from a mooring to open water.

In typical engine/exhaust assemblies, the sea water pump is operated any time the engine is running. Typically, pump speed is correlated to engine speed, such as by coupling the sea water pump to the engine crank shaft, or to a drive shaft which is connected to the engine crank shaft. The sea water pump is typically driven either directly off the crank shaft or off the "lower unit" drive shaft. The "lower unit" is, generally speaking, that portion of the drive system which is under water when the boat is under way.

The problem with water jacketed cooling is that, at low engine speeds, relatively lower volumes of exhaust gases are flowing through exhaust pipes which are sized and configured to handle the relatively higher volumes of high temperature exhaust gases which are generated at high power output. Thus, at low engine speeds, the gas flow rates are relatively low. In addition, the exhaust gases cool rapidly, both because of the rapid expansion in the relatively quite large exhaust pipes which are sized to handle larger gas volumes, and, because the flow of cooling water through the water jacket keeps the walls of the pipes in the exhaust system quite cool.

It is well known that exhaust gases from internal combustion engines contain large quantities of water vapor. In the cool, slow-flow conditions of the above exhaust systems at low engine speeds, and as the engine cools from e.g. a high speed run, the water vapor begins to condense inside the exhaust pipes, and the initiating locus of condensation moves progressively closer to the engine exhaust ports as the exhaust system progressively cools. As the exhaust system becomes progressively cooler, the quantity of condensed liquid water in the exhaust system increases, and the threshold location of such condensation thus moves progressively closer to the engine.

At low engine speed operation, the gas flow rate can become too slow to physically entrain and carry the water away from the engine. At the low operating temperatures present during low-speed operation, and when full rated cooling water flow is maintained in the water jacket, the temperatures on the inside surfaces of the exhaust pipes close to the engine are sufficiently cool to cause water vapor in the exhaust gases to condense on the inside surfaces of the exhaust pipes proximate the engine exhaust ports.

In most marine engines, the exhaust gases are flowing upwardly as or shortly after they exit the engine at the exhaust ports, and then flow downwardly to the exhaust tip, and typically discharge the exhaust gases under the water, thereby using the water in part as a muffler of engine sound. In some marine engines, the exhaust gases flow upwardly, and then rearwardly of the boat to a discharge in the air. In such case, it is known to inject cooling water from an exhaust system water jacket into the exhaust gas stream in order to assist in muffling the sound of the engine exhaust.

Whatever the structure of the exhaust system, the result is that eventually, over a prolonged period of idle/low speed operation, condensed water can flow by gravity downwardly toward, and into, one or more of the engine exhaust ports, and from there into the respective engine cylinders, causing the above noted engine shut-down or other engine malfunction or damage.

For a given marine engine/exhaust assembly, at some critical engine speed, which can be unique to each model of engine/exhaust assembly, or other combination of engine and exhaust, the rate of heat generation in the exhaust system in combination with the rate of flow of gases through the exhaust system, are effective to physically carry the exhaust gases away from the engine ports and past the peak vertical elevation of the exhaust pipes such that either the gas flow rate physically entrains the condensate, and carries the liquid condensate out of the exhaust system at the exhaust tip, or the heat is sufficient to prevent formation of condensate close enough to the engine to cause a problem, or to vaporize any condensate already formed.

However, that critical engine speed is typically well above idle speed. In some relatively lower performance engine/exhaust assemblies, the exhaust system components remain hot enough over prolonged, periods of operation to cause any such condensed water to re-evaporate and thus be carried out of the exhaust system.

By contrast, other engine/exhaust assemblies, especially high performance engine/exhaust assemblies, do not so avoid ongoing presence of condensed liquid water, whereby the invention herein can be employed for the benefit of such engines.

Thus, it is an object of the invention to provide a control system, for marine exhaust systems, which limits accumulation of liquid water in the exhaust system, near the engine, to no more than amounts which are consistent with continued effective operation of both the engine and the exhaust system.

It is another object of the invention to provide a marine exhaust system having a control system which limits accumulation of liquid water in the exhaust system, near the engine, to no more than amounts which are consistent with continued effective operation of both the engine and the exhaust system.

It is yet another object of the invention to provide a marine drive assembly, including engine and exhaust, having a control system which limits accumulation of liquid water in the exhaust system, near the engine, to no more than amounts which are consistent with continued effective operation of both the engine and the exhaust system.

Still another object of the invention is to provide a method of limiting accumulation of liquid water in one or more exhaust chambers of an associated exhaust system, by controlling flow of cooling water in the exhaust system sufficient to maintain temperatures in the exhaust system at such levels as to limit accumulation of liquid water in one or more exhaust chambers of the exhaust system, proximate exhaust gas discharge ports of the engine, to no more than amounts of liquid water which are consistent with continued effective operation of both the internal combustion engine and the exhaust system.

SUMMARY

In the invention, the flow of cooling sea water to exhaust system water jackets is temporarily eliminated, reduced, or otherwise restricted, under operating conditions where continuous flow of the sea water through the water jackets at rated speed-related flow rates, can run elevated risk of developing undesired levels of liquid water close to the engine. The method of accomplishing the above control of water flow is to turn on or off a sea water pump, either by turning on or off the power to the pump, or by engaging and disengaging a clutch connected to the sea water pump.

Alternatively, a flow control valve in the sea water line can be opened and closed, or modulated, to restrict or stop flow of cooling water to the exhaust system. Still another alternative is to operate a diverter valve in the sea water line, opening and closing the valve, or modulating water flow rate through the valve, to divert cooling water away from the exhaust system. The rate of flow of sea water to the exhaust system can, in the alternative, be restricted or modulated by other means such as by modulating output of the sea water pump.

Thus, the invention comprehends a family of embodiments comprising a control system for use in a marine exhaust system, a corresponding marine exhaust system, and a respective marine drive unit. The marine exhaust system is adapted for connection to an internal combustion marines engine at an inlet end of the marine exhaust system. The internal combustion marine engine has one or more exhaust gas discharge ports. The marine exhaust system comprises one or more exhaust chambers which define an exhaust gas discharge path for conveying exhaust gases from the one or more exhaust gas discharge ports of the internal combustion marine engine to an exit end of the exhaust gas discharge path. The marine exhaust system is designed to use flowing cooling water to control temperatures in the exhaust system, along the exhaust gas discharge path. The control system comprises sensing apparatus sensing at least one parameter. The at least one parameter is related to accumulation of liquid water in the one or more exhaust chambers proximate the inlet end of the marine exhaust system. The control system further comprises an electronic controller receiving, from the sensing apparatus, a signal representing the at least one sensed parameter and, in response to the signal representing a value of the at least one parameter indicating propensity for, or actual, accumulation of liquid water in the one or more exhaust chambers, proximate the inlet end of the marine exhaust system, generating a control signal. Yet further, the control system comprises water flow control apparatus receiving the control signal from the electronic controller and controlling flow of cooling water in the marine exhaust system, sufficient to maintain temperatures, in the marine exhaust system, at such levels as to limit accumulation of liquid water in the one or more exhaust chambers and proximate the exhaust gas discharge ports, to no more than amounts which are consistent with continued effective operation of both the internal combustion marine engine and the marine exhaust system.

In preferred embodiments, the sensing apparatus is selected from the group consisting of an engine speed sensor, a throttle setting sensor, an engine temperature sensor, a heat exchanger sea water temperature sensor, an engine sea water temperature sensor, an engine coolant temperature sensor, an exhaust gas flow rate sensor, an exhaust manifold temperature sensor, a manifold pipe temperature sensor, and an exhaust water jacket temperature sensor.

In some embodiments, the electronic controller comprises an engine electronic control module adapted to control general operation of a respective such marine engine.

In some embodiments, the electronic controller comprises a control module separate and distinct from any electronic engine control module.

In some embodiments, the water flow control apparatus comprises an on/off clutch.

In some embodiments, the water flow control apparatus comprises a variable speed clutch.

In some embodiments, the water flow control apparatus comprises a variable speed sea water pump.

In some embodiments, the water flow control apparatus comprises an on/off valve adapted for use between the engine and the exhaust intake, optionally comprising a diversion line out of said on/off valve.

In some embodiments, the water flow control apparatus comprises a modulating valve adapted for use between the engine and the exhaust system, optionally further comprising a diversion line out of the modulating valve.

In some embodiments, the water flow control apparatus comprises a flow-controlling clutch on the engine, and one or more flow diverter valves between the engine and the exhaust system.

Some embodiments include control structure, optionally included, or not, in the electronic controller, optionally a timer, or not, providing a pre-determined minimum flow of cooling water to the exhaust system, and overriding all other commands of the control system after activation of the control system.

In some embodiments, the water flow control apparatus further comprises a database representing modeling one or more of engine speed, exhaust temperature, and cooling water flow rate in a given combination of the engine and the exhaust system.

In a second family of embodiments, the invention comprehends a method of of limiting accumulation of liquid water in the one or more exhaust chambers proximate the exhaust gas discharge ports of an internal combustion marine engine. The exhaust system is connected to an internal combustion marine engine at an inlet end of the exhaust system. The internal combustion engine has one or more exhaust gas discharge ports. The exhaust system comprises one or more exhaust chambers which define an exhaust gas discharge path for conveying exhaust gases from the one or more exhaust gas discharge ports of the engine to an exit end of the exhaust gas discharge path. The exhaust system is designed to use flowing cooling water to control temperatures in the exhaust system, along the exhaust gas discharge path.

The method, comprises activating a control system which activates sensing of at least one parameter using sensor apparatus, the at least one parameter being related to accumulation of liquid water in the one or more exhaust chambers proximate the inlet end of the marine exhaust system. The method further comprises sending a signal from the sensor apparatus to an electronic controller; using the controller, and in response to the signal from the sensing apparatus indicating propensity for, or actual, accumulation of liquid water in such one or more exhaust chambers proximate the inlet end of the exhaust system, generating a control signal; and responsive to the control signal, controlling flow of cooling water in the exhaust system, sufficient to maintain temperatures in the exhaust system at such levels as to limit accumulation of liquid water in the one or more exhaust chambers and proximate such exhaust gas discharge ports, to no more than amounts which are consistent with continued effective operation of both the marine engine and the marine exhaust system.

In preferred embodiments, the method comprises sensing of at least one parameter selected from the group consisting of engine speed, throttle setting, engine temperature, heat exchanger sea water temperature, engine sea water temperature, engine coolant temperature, exhaust gas flow rate, exhaust manifolds temperature, manifold pipe temperature, and exhaust water jacket temperature.

In some embodiments, the method further comprises controlling flow of cooling water only when engine speed is at or below a critical upper threshhold engine speed.

In some embodiments, the method further comprises controlling flow of cooling water only when engine speed is at or below a selected engine speed substantially below full rated power output of the respective engine.

In some embodiments, the method includes controlling flow of cooling water to the exhaust system by intermittently shutting completely off flow of cooling water to the exhaust system, and subsequently turning flow of cooling water back on, optionally by turning off, and then back on a clutch connected to a sea water pump associated with the marine engine, optionally in combination with the on/off flow of cooling water, or not, by also modulating rate of flow of cooling water when water flow is turned on, to a rate less than full rated flow.

In some embodiments, the method includes controlling flow of cooling water to the exhaust system by turning water flow off, and subsequently on, in cycles, according to a pre-set timing sequence.

In some embodiments, the method includes intermittently turning off, and subsequently back on, flow of cooling water using a valve between the engine and the exhaust system.

Some embodiments include modulating flow of cooling water to the exhaust system using a modulating valve between the engine and the exhaust system.

Some embodiments include monitoring engine speed, modulating flow of cooling water to the exhaust system above a pre-determined engine speed, and when the engine is operating below the pre-determined speed, intermittently turning off flow of cooling water and subsequently turning flow of cooling water back on, in cycles.

Some embodiments include sensing an exhaust system temperature and, irrespective of engine speed, and optionally based only on the sensed exhaust system temperature, controlling flow of cooling water to the exhaust system in accord with pre-selected trigger water temperatures or a target water temperature in combination with a temperature tolerance range.

The method preferably includes also sensing engine speed, and implementing the control of cooling water to the exhaust system only when engine speed is below a predetermined threshold engine speed.

In preferred embodiments, the method includes providing a pre-determined minimum flow of cooling water to the exhaust system, overriding all other commands of the control system any time the control system has been activated.

In some embodiments, the engine includes an electronic control module, and the method includes providing, as the controller, a system control module, separate and distinct from the engine electronic control module, the system control module communicating with the engine electronic control module.

Some embodiments of the method include modeling a combination of engine and exhaust, thereby collecting temperature response data representative of exhaust system temperature at various engine speeds, as related to time at the respective speeds, and controlling flow of cooling water to the exhaust system at least in part based on the data in the database which is representative of the respective engine and exhaust.

Figure 1:
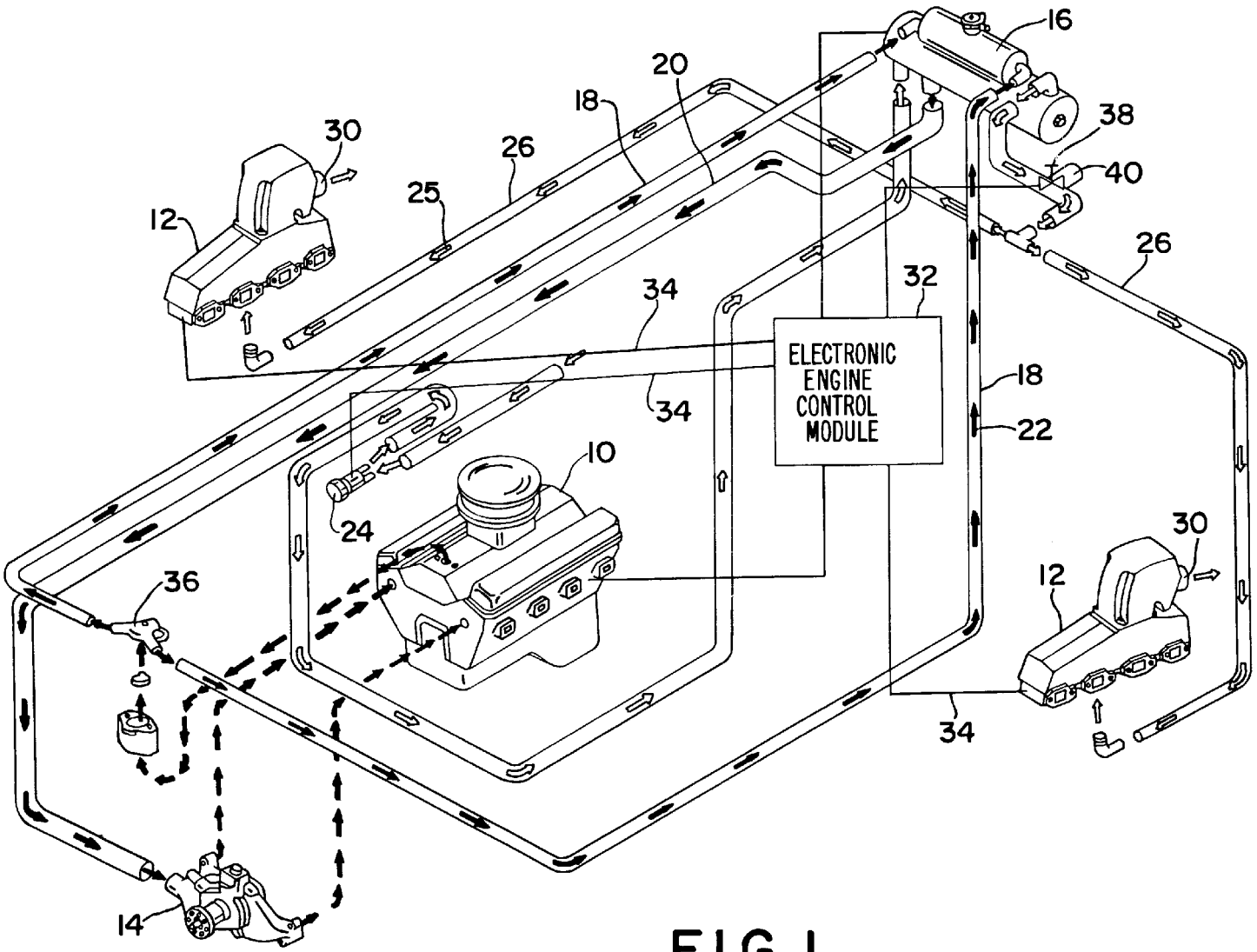
FIG. 1 sows a representative diagram of a marine engine and exhaust system, using a closed coolant loop between the engine and a sea water-cooled heat exchanger.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Since the flow of sea water to the exhaust system is critical to operation of the exhaust system at high power output, it is critical that the inventive control system be employed only under certain operating conditions of the engine and exhaust system. There is, however, a range of operating conditions wherein the combination of engine and exhaust system will operate satisfactorily either with or without unrestricted flow of cooling water to the exhaust system.

As a first condition, if water flow is restricted significantly at high power output, the primary cooling purpose of the water jackets in the exhaust system is being defeated, whereby the primary cooling function of the water jackets, and the water correspondingly injected into the exhaust gas stream, is not achieved. Thus, a critical first condition for activation of a control system for preferred embodiments of the invention, which embodiments significantly restrict water flow at fixed restriction rates, such as periodically and intermittently turning water flow completely off, then back on, according to the invention is that the engine heat output must be below a specified upper threshold.

A reasonable proxy for engine heat output can be defined in terms of a "critical upper threshold" engine speed. Above the specified engine speed critical upper threshold, water flow through the exhaust system water jacket or jackets is typically not restricted by control systems of the invention. The critical upper threshold speed will vary from engine to engine and also from exhaust system to exhaust system, and accordingly with respect to engine/exhaust combinations. Thus, the critical threshold upper engine speed is likely to be unique to each combination of engine model and exhaust system model.

The critical upper threshold engine speed is that speed above which cycling the water full off, then back on, must be done so frequently as to be ineffective either in terms of control system cost or component wear. However, it should be understood that water flow rate can be modulated by control systems of the invention above the critical upper threshold engine speed. Such modulation is, typically, ceased at engine speeds substantially below maximum rated output. With all the above as foundation for information, a typical critical upper threshold engine speed is approximately idle plus about 1100 rpm. Since idle speed is typically in the range of about 900 rpm, critical upper threshold engine speed is typically about 2000 rpm.

As indicated above, for any combination of engine and exhaust system, there is a discretionary range of engine speeds, at which both the engine and exhaust system can operate satisfactorily either with or without full rated flow of cooling water in the exhaust system. Under such conditions, sufficient cooling water is nonetheless used to protect e.g. rubber components of the exhaust system from overheating, unless cooling of such rubber components is otherwise provided for. The upper end of this speed range is the critical upper threshold speed. Thus, at any speed at or below the critical threshold engine speed, the water flow restrictions of the invention can be employed.

As used herein, "full rated flow" of cooling water is that flow rate which exists absent employment of a control system of the invention. For example, where the sea water pump is mechanically coupled to the engine crank shaft, for example through a pulley system, full rated flow is that flow which results from the designed coupling of the sea water pump to the crank shaft, without further control or other restriction. Such flow rate out of the sea water pump, of course, fluctuates with changing speeds of the engine according to the sea water pump design and coupling of the sea water pump to the engine.

Engine speed at the lower end of the range of engine speeds is defined herein as the "critical lower threshold." When the engine runs at or below the critical lower threshold speed, by definition the risk of water flowing back into the engine at the exhaust ports, either from condensation or reversion, is sufficiently high that prudence suggests that a control system of the invention should be implemented.

The "operating range" of speeds between the critical upper threshold and the critical lower threshold is that discretionary range of speeds, wherein the water cooling system can be operated either at full rated water flow, or at a lower but fixed restricted flow. In such fixed restricted flow, either cooling water flow can be intermittently cycled completely off, then turned back on, or such cooling water flow can be modulated, consistent with activation of the control system of the invention.

Where the water flow is cycled on and off, the water flow rate in the "on" condition can be less than the full rated flow of water which would occur absent the invention. Thus, in such situation, the water flow can be both modulated in rate, and intermittently cycled off and then back on. Accordingly, initiating operation of a control system of the invention in full off/on mode can, at the discretion of the user, be set up to be implemented at any engine speed in the discretionary speed range; not higher than the critical upper threshhold speed; not lower than the critical lower threshold speed.

A typical lower threshold speed is about idle plus 600 rpm. Using the above basis, a typical critical lower threshold speed is about 900+600=1500 rpm. Thus, where the discretionary range is between 1500 rpm and 2000 rpm, the control system of the invention is preferably activated any time the engine speed is between 1500 rpm and 2000 rpm. At engine speeds below 1500 rpm, the invention should be activated in order to provide temperature controls needed by the engine and exhaust system. Above the upper threshold speed, e.g. 2000 rpm, the invention is typically inactive, especially in the on/off flow control mode.

As used herein, "activating" the control system of the invention means to initiate system operation such that activities dictated by the control system of the invention begin to operate. A typical activation comprises using a software command in the controller to close a solid state switch in the controller, which switch controls access to the remaining functions of the control system. In such scenario, one such activity is inaction of the control system, whereby full rated flow of cooling water is flowing through the exhaust system, as when the temperature in the exhaust system is in balance with the needs of the exhaust system and the engine, and no limitation of cooling water flow is needed.

While operation of a control system of the invention can be implemented above the critical upper threshold, the restricted flow must be changed dynamically with engine speed changes, as a proxy for engine heat output, in order to match cooling effect to changing cooling needs of the exhaust system created by any ongoing changes in engine speed. Such ongoing changes in water flow required by the engine and exhaust system, above the critical upper threshold speed, requires relatively higher levels of sophistication in the control system of the invention, and thus are not preferred for cost reasons. Further, implementation of the invention must be initiated below the critical lower threshold engine speed in order to avoid the engine operational problems associated with excess cooling in the exhaust system.

On the other hand, where operating temperature of the engine and/or exhaust system must be controlled within a more restrictive temperature range, such as for environmental impact reasons, the invention can well be implemented at engine speeds above the critical upper threshold engine speed. In such case, the flow of cooling water is never completely shut off. Rather, the electronic engine control module, or other electronic computer controller, regulates cooling water flow dynamically, changing the water flow volume in real time, in accord with ongoing changes in engine speed and/or engine heat output.

In any embodiment of the invention wherein engine speed is employed as an element of the invention herein, for example as a basis for controlling water flow, throttle setting can be used as a proxy for engine speed.

Any time the engine is operating at or below the critical upper threshold speed, the preferred cyclic full on/full off restricted flow version of the control system of the invention is susceptible of use, where any one or more of a second set of conditions is optionally used to further screen use of the invention control system on/off function.

In a first exemplary set of embodiments, a first control system operates under a first set of conditions as follows. The control system is activated at a selected engine speed at or below the critical upper threshold engine speed. In such situation, the control system operates in a regularly repeating on/off cycle wherein the water flow to the exhaust system water jackets is on for "x" seconds then off for "y" seconds, and the cycle is repeated as long as the engine speed is below the selected engine speed.

This first system is based on empirically-selected timing only, and requires only an engine speed sensor and a timer, in addition to an electronic control module and a flow control actuation unit. The electronic control module can be the engine electronic control module, or can be a separate control module. In the event of use of a separate control module, such separate control module typically is in electrical communication with the engine control module, thus to receive inputs from the engine control module. The engine speed sensor can be the tachometer which is typically supplied as part of the engine instrumentation, and which receives its input from the engine.

Whichever control module is used, since the "x" and "y" on/off times are constant settings, the "selected" engine speed is typically specified at or near the critical lower threshold engine speed.

In a second set of exemplary embodiments, a second control system operates under a second set of conditions as follows. One or more representative units of the engine/exhaust assembly combination is subjected to substantial testing of "x" and "y" on/off timing, and temperature responses of the exhaust system, over a wide range of engine speeds, engine temperatures, power outputs, and sea water temperatures. The water jacket temperatures, typically proximate the exit locus of the water jacket, are recorded.

Given a sufficiently large database of information, in this second set of embodiments, the on/off timing of the above first embodiment is set at a constant on/off time sequence in accord with a sensed engine speed or engine temperature, to provide desired cooling in combination with efficient engine operation, at a selected range of engine temperatures or engine speeds smaller than the entire range of specified temperatures or engine speeds within which the engine operates.

The entirety of the range of temperatures or speeds within which the engine can operate is then divided for or by the control system controller into two or more, preferably no more than 10, optimally 4 to 8, temperature ranges or engine speed ranges, or throttle settings. Using the database, the controller identifies a preferred, typically distinct, timing sequence for each different temperature range or engine speed range.

As the operating speed or operating temperature of the engine changes from a given temperature range or engine speed range to a different temperature range or engine speed range, the controller adjusts the on/off timing of cooling water flow in accord with the database indication for the different temperature range or engine speed range. In this embodiment, since the "x" and "y" on/off times are re-set by the controller as engine speed changes, the selected activation engine speed can be anywhere within the operating engine speed range of the control system of the invention.

As a further refinement of the invention, one can establish the database using any combination of e.g. engine speed parameters, engine temperature parameters, and exhaust gas temperature parameters, and can then draw on either the engine speed data, the engine temperature data, or the exhaust temperature data, in setting the on/off timing sequence.

This second embodiment requires the timer used in the first embodiment, in combination with a database, the control unit which draws on the database to control the timer once the control system is activated, and the flow control actuation unit.

In a third exemplary set of embodiments, a third control system operates under a third set of conditions as follows. The database in the second embodiment above is optionally used to develop optimum modulated water jacket flow rates for a wide range, optionally the entire anticipated useful range of engine speeds or engine temperatures, and modulated exhaust water flow rates are then adjusted dynamically, in real time, according to the engine speed or engine temperature. A such database as described above can optionally be used to correlate engine speed or temperature, or exhaust system temperature, to cooling water flow rate.

In this third embodiment, water flow rates through the exhaust system are preferably adjusted by the controller at relatively short time intervals even at moderate engine speeds. Time intervals between flow rate adjustments can be as long as 1 minute or more, but are typically measured in seconds or fractions of a second. In preferred embodiments, the controller samples the parameter of interest, such as engine speed or a relevant temperature, at intervals of less than 1 second, such as 0.01 second to about 0.5 second, or continuously at the sampling rate limit of the controller, and up-dates the instructed water flow rate to a flow rate actuator in accord with each such sampling or each nth sampling.

Also in this embodiment, the selected engine speed at which the control system of the invention is activated can be higher than in the previous embodiments since water flow rate to the exhaust system is modulated rather than being turned on and off. This third embodiment modulates the rate of flow based on engine speed or an appropriate, temperature.

This third embodiment requires the controller, the engine speed sensor, a properly-located temperature sensor, a modulating capability, and optionally a database. The modulating capability can be achieved either by actively controlling output of the sea water pump or by passing the water through a flow control valve. Such flow control valve is located ahead of the exhaust system water inlet. Since the sea water pump is preferably mechanically coupled to the engine drive, the modulating effect is preferably achieved by suitable such valving. In such instance, the excess water can be diverted through a discharge line back to the sea.

In the alternative, and in any of the embodiments, the diverted sea water can simply be routed past the water jacket and be fed into the exhaust gas stream downstream of the water jacket. In such case, no default stream of water need be used for cooling rubber components of the exhaust system because such components are adequately cooled by the water injected into the exhaust gas stream.

In a fourth set of exemplary embodiments, the control system operates under a fourth set of conditions as follows. The engine electronic controller, also referred to herein as the engine electronic control module, monitors temperature of e.g. the sea water at the outlet end of the exhaust system water jacket, and/or at the exhaust manifold, and/or at the heat exchanger discharge to the exhaust system in a closed cooling system, in real time, under pre-selected conditions such as below a selected engine speed. In the alternative, the engine electronic controller monitors temperature of the sea water discharge from the engine or the heat exchanger in a closed system, at all times during operation of the engine. The engine electronic controller turns the water flow on or off, or modulates rate of water flow, according to the sensed water temperature, at the selected location, e.g. exhaust end of water jacket and/or heat exchanger discharge, or at any other location which indicates temperature in the exhaust system proximate the engine exhaust ports, at any given time to thereby control/limit the flow of water through the exhaust system. This fourth embodiment modulates the rate of flow, or timing of on/off cycles based on sensed water temperature, and thus requires a temperature sensor at any sensing location of interest.

The higher the engine speed, the less restriction can be put on cooling water flow through the exhaust system without damaging the exhaust system. As engine speed rises above the critical upper threshold speed, any restriction on cooling water flow through the exhaust system is limited to modulating flow rate. As the engine speed approaches rated power output, water flow modulation ceases, and full rated cooling water flow takes over. In this fourth embodiment, the control system can optionally be initiated at engine start-up, and can remain active at all times during engine operation. Thus, this fourth system requires only a temperature sensor, the controller, and a flow control actuation unit.

The control system of the invention can be set up to initiate operation of the control system as engine-speed decreases, as a modulated rate of water flow, and then convert to on/off flow as engine speed is further reduced into the operational window below the critical upper threshold speed. The second step, namely the on/off flow, can be either full rated flow, or a modulated rate of flow. Similarly, if engine speed is subsequently increased to a speed above the operational window, modulated flow can be restored.

In all embodiments of the invention, whether or not explicitly disclosed and/or illustrated, and whether or not preferably used with on/off actuation, as the engine speed increases to the point where the full rated flow of liquid water in the exhaust system is inherently and always physically entrained in the exhaust gases, and where exhaust gas flow rate is thus sufficient to negate any possibility of reversion, the value of on/off actuation of flow control is lost, whereby the value of the efficiency of modulated constant water flow is greater than any value of on/off actuation. Accordingly, in those instances where the control system is maintained active at such higher engine speeds, modulated water flow control is typically preferred. To that end, however, switching from on/off flow control at lower engine speeds to modulated flow control at higher engine speeds requires a control system which can perform both functions. Such dual-function system is more costly than a single-function system, but such dual function system can have other value such as where environmental issues are implicated.

The flow control actuation unit can be as simple as an on/off clutch on the sea water pump, which turns the sea water pump off, and on. The on/off cycles are controlled by the controller.

In the alternative, the sea water pump can be coupled to the engine drive mechanics through a variable speed drive such as a variable speed clutch. In such instance, the controller controls the variable speed drive.

The sea water pump can be electrically driven and the controller controls drive speed.

Whether or not the output of the sea water pump is controlled by the controller, one or more flow control valves, or other flow control device, can be positioned between the sea water pump and the exhaust system. For use herein, one can select control valves which operate as 2-position e.g. on/off valves, or can select valves having infinitely variable flow settings, or valves capable of operating in both the on/off and variable setting modes.

In addition to the above controls, the dual chamber thermostat conventionally used on the marine engine, where the second thermostat chamber passes cooling water to the exhaust system only after the first chamber releases hot water from its engine cooling function, is maintained in its conventional location with respect to the engine, operating in its conventional role. Typically, but not necessarily, all other engine components, such as fuel filter, fuel pump, water circulating pump in a closed coolant system, environmental controls, and the like engine accessories, are maintained unchanged as a result of using the control system of the invention. Such accessories can, of course, be modified as desired to gain any advantage available from use of control systems of the invention.

Where control of cooling water flow, in the control system of the invention, is based on one or more sensed temperature, the temperature reading can be taken at any location in the engine or exhaust system which is a proxy for temperature of exhaust system components and/or a proxy for the probability that liquid water will accumulate in the exhaust system adjacent the engine exhaust ports. As temperature sensor locations, there can be mentioned, for example and without limitation, in a closed coolant system as in FIG. 1, jacket water temperature in the exhaust manifold or in an exhaust pipe, engine coolant, e.g. ethylene glycol, temperature in the engine block or the heat exchanger, or exhaust manifold or exhaust pipe temperature proximate the exhaust ports of the engine.

In a simple embodiment of the invention, a temperature sensor such as a thermal switch, is mounted to the exhaust manifold, and powered by a wire leading from the battery or other power source. An on/off solenoid is mounted to a clutch at the sea water pump, and communicates with the thermal switch through a connecting electrical wire. The system, thus includes only the thermal switch and the solenoid. The thermal switch acts in a sensing function. The solenoid receives signals from the thermal switch, and turns the clutch on and off according to signals received from the thermal switch. Thus, the solenoid acts as an electrical controller, receiving the sensory signals from the thermal switch, and activating or deactivating the clutch accordingly.

In place of the clutch, a diverter valve can be used. The diverter valve receives the signal from the thermal switch and diverts cooling water as described in other embodiments herein, either back to the sea or to the exhaust system downstream of the water jacket.

The above described very simple system can be electrically powered any time the engine is running. In a refinement of the thermal switch example, the signal from the thermal switch can be sent to, and further processed by, an electronic controller/computer prior to an action signal being advanced to the solenoid or other actuation component at the sea water pump, or to e.g. a diverter valve.

Figure 2:
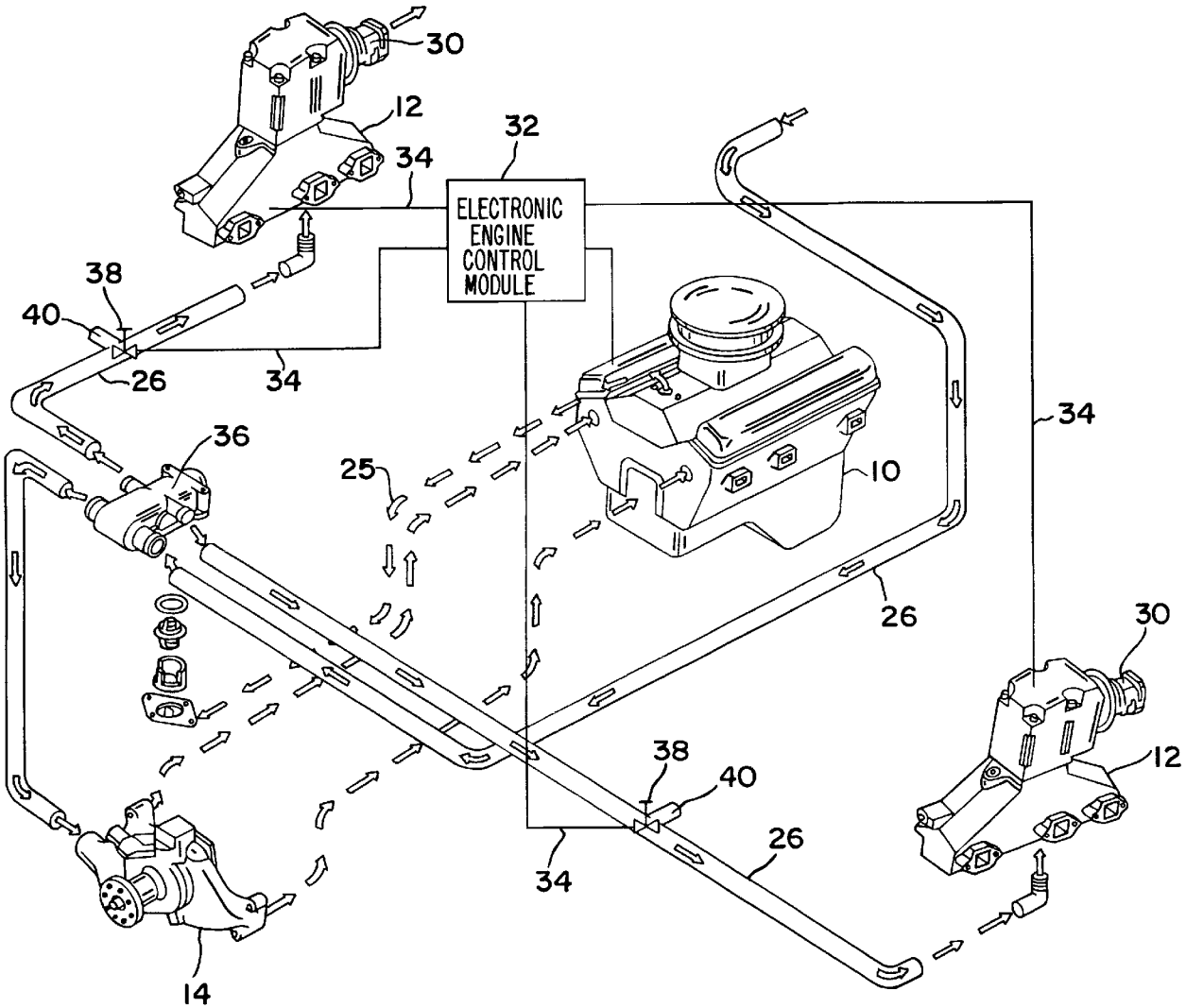
FIG. 2 shows a representative diagram of a marine engine and exhaust system, using an open coolant loop where a common, flow of sea water cools first the engine block, and then the same sea water cools the exhaust system, where the sea water pump is mounted on the lower unit.
Figure 3:
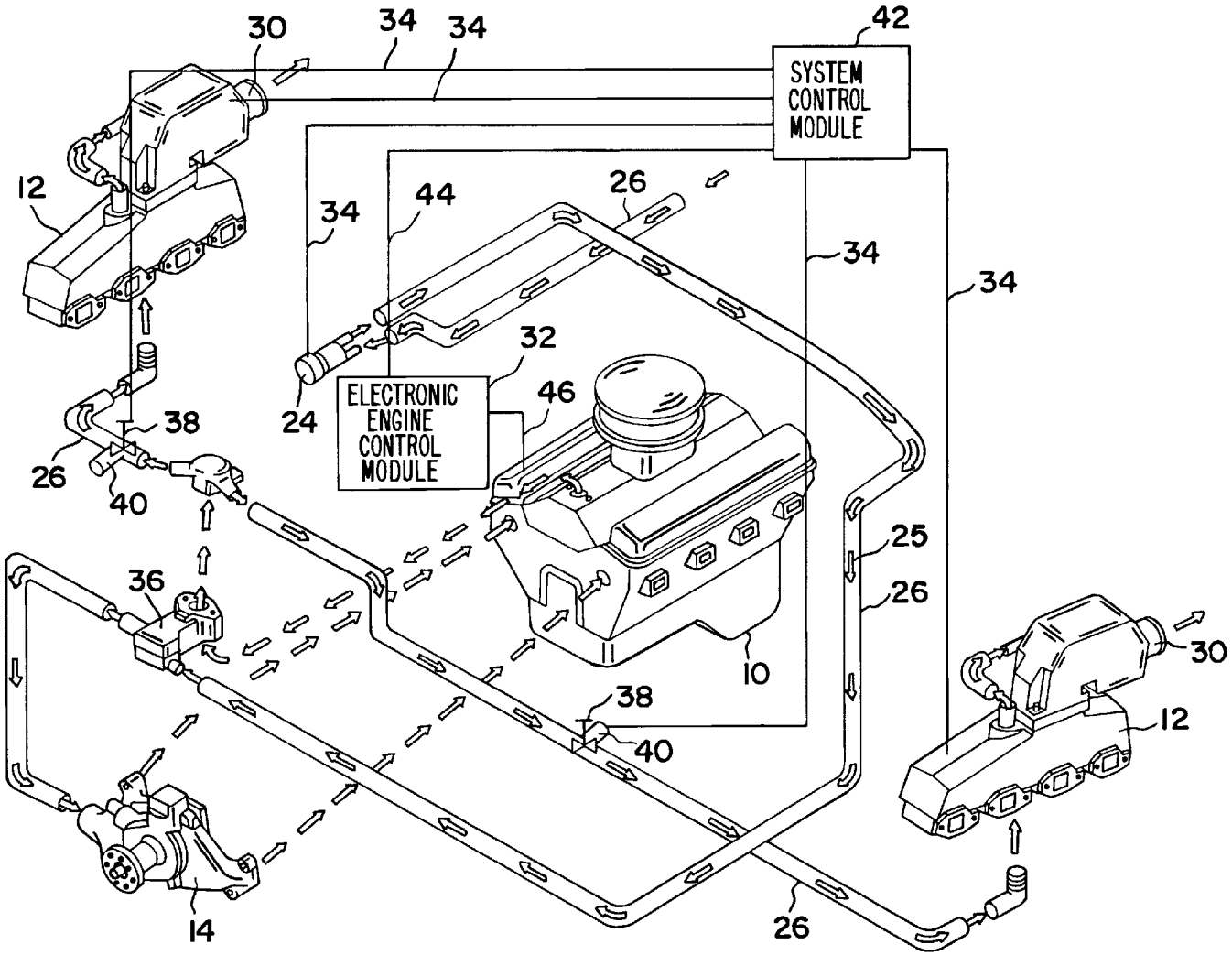
FIG. 3 shows a representative diagram of a marine engine and exhaust system, using an open coolant loop where a common flow of sea water cools first the engine block, then the same sea water cools and the exhaust system, where the sea water pump mounted on the engine crank shaft.

In an open system, such as in FIGS. 2 and 3, sea water flows through the engine block, and thence through the exhaust system, whereby the sea water which cools the exhaust system also cools the engine block. The cooling water flows first to the engine block and picks up engine heat. After cooling the engine block, the already-heated water then flows to the relatively hotter exhaust system, and cools the exhaust system. In such open system, there can be mentioned, as exemplary loci for taking temperature readings, jacket water temperature, exhaust manifold temperature, and engine block temperature. As with the closed system, temperature can also be sensed at a variety of locations not mentioned herein, so long as the sensed temperature is representative of condensation conditions, or other risk of accumulation of liquid water, inside the exhaust gas conduit proximate the exhaust ports of the engine.

Most, though not all marine exhaust systems, employ rubber components. Because of the sensitivity of such rubber components to heat, it is critical that the temperatures to which such rubber components are exposed be strictly limited. As noted above, such exhaust systems inject the water jacket water into the exhaust gas stream, downstream of the water jacket. Such injected water quickly mixes with and cools the exhaust gases, thus controlling the temperatures in the exhaust gas stream, at such rubber components, at temperatures which can be tolerated by such rubber components. However, such cooling for purposes of protecting rubber components is not needed where the exhaust system contains no rubber components.

Control systems of the invention operate on the principle of limiting the amount of cooling sea water which reaches the exhaust system. Thus, a condition of the invention, where heat sensitive e.g. polymeric-type materials are used in the exhaust system, is to maintain a default minimum amount of water flow in the exhaust system for the purpose of protecting such heat sensitive materials from overheating. Such default flow can be either in the form of constantly flowing water, at a reduced rate, on/off flow at a reduced flow rate, or on/off flow at rated flow capacity. Where the exhaust system contains no such temperature-sensitive components, the default flow is not needed.

Since reducing reversion is an object of the invention, and since reversion can occur only when water is present in the exhaust gas conduit, one way for the invention to achieve this objective is to limit the fraction of the time when water is being injected into in the exhaust gas conduit. Thus, preferred embodiments of the invention, especially at slower engine speeds, avoid constant, modulated, water flow, and seek to reduce to an optimum, the fraction of the time when water is being injected into the exhaust gas conduit. Accordingly, preferred embodiments of the invention employ on/off water flow rather than modulated water flow. Within the on/off flow universe, relatively higher water flow rate brings the rubber components to a desired lower temperature more quickly than relatively lower flow rates. Thus, relatively higher flow rates are preferred, and rated sea water pump output rates are most preferred in most instances.

Thus, in all of the above scenarios, and irrespective of any other controller calculations or other determinations; a default amount of Cooling water is always caused to flow through the exhaust system, preferably in on/off cycles, to protect the more temperature sensitive parts of the exhaust system. Thus, even where cooling water flow is not required for purposes of cooling the exhaust pipes adjacent the engine, namely to avoid accelerated burn-through at or adjacent the engine or in an exhaust manifold, the water is nevertheless periodically cycled on for short periods of time, including injecting the jacket water into the exhaust gas stream, or water flow is maintained at a low rate of flow at all times. For example, water flow might be cycled on for 1–2 seconds every 30–60 seconds, or modulated flow might be maintained at about 10 percent to about 20 percent of unrestricted rates of flow. Since reversion is most prominent at relatively lower engine speeds, and since reversion cannot occur based on injected water when water flow is completely shut off, at low engine speeds the on/off cycling is preferred over a modulated/reduced flow rate of constantly flowing water. Thus, especially at engine speeds below 1500 rpm, control systems of the invention are preferably setup to periodically cycle the cooling water to the exhaust system completely off, then back on.

In most cases, a single sea water pump, and/or sea water supply line, supplies cooling water in series to the engine block cooling system and thence to the exhaust system cooling components. In such cases, any restriction of flow of cooling sea water to the exhaust system must be tempered by the ongoing demands for flow of cooling water to the engine. In such situation, the sea water pump must supply the greater of the quantity of water needed to cool the engine and the quantity of water needed to cool the exhaust system. Suitable diversion lines or valves are incorporated into the sea water lines, as needed, to provide for such sea water flow for cooling the engine while not necessarily running the same amount of sea water through the exhaust system. Especially where the quantity of water needed to cool the engine is greater than the quantity of water needed to cool the exhaust system, any excess quantity of water exiting the engine and not needed by the exhaust system, can be diverted by a diverter valve, e.g. back to the sea.

Such diversion can require ongoing adjustment of e.g. flow rate by the electronic controller as exhaust system cooling water requirements can fluctuate more than engine block cooling water requirements. Of course, where the engine block can accommodate the same cooling water adjustments as the exhaust system, no diverter valve, or control of same, is needed In an embodiment not shown, a separate, second sea water pump supplies cooling sea water to the exhaust system independent from, and in parallel with, the cooling sea water which is supplied to the engine by the sea water pump illustrated in the drawings.

In an open system, the sea water is routed directly from the sea water intake to and through the block. The water can be routed from the block directly back to the sea. In such case, sea water can be fed in parallel from the sea water pump, into the exhaust system. Since the same pump supplies both the engine block and the exhaust system with cooling water, the apportionment of water flow is established to always supply an excess of cooling capacity to the engine and to the exhaust system. To the extent the sea water pump capacity is greater than needed, the controller can operate diverter valves to divert the excess water as needed. If the sea water pump is electrically operated, the controller controls power to the sea water pump to limit pump output to the quantity needed.

In a closed system as illustrated in FIG. 1, ethylene glycol flows in a closed loop between the engine block, where it receives heat from the engine, and a heat exchanger where the ethylene glycol is cooled by sea water. The sea water pump supplies cooling sea water to the heat exchanger. The sea water exhausted from the heat exchanger then goes to the exhaust system to subsequently provide cooling to the exhaust system. In the invention, a fraction of the cooling water is diverted from the exhaust system, and returned to the sea when not needed to cool the exhaust system.

A temperature sensor at e.g. the sea water outlet from the heat exchanger, or at the exhaust manifold, or at the water jacket outlet, can be used as basis for the controller controlling water flow through the exhaust system. Where exhaust system temperatures are sensed, the temperature is preferably sensed in each exhaust manifold or water jacket, and a separate control, e.g. diverter valve, is used with each such exhaust manifold or water jacket to separately control temperature of the cooling water being sensed by the respective sensor.

In the alternative, and especially at low engine speeds, the sea water flow through the heat exchanger can be cycled on and off, or the water flow rate modulated, rather than using a diverter valve. Such flow limitations through the heat exchanger, of course, presumes that the reduced water flow is sufficient to maintain the engine at a suitable operating temperature.

Any of the mentioned diversions can take the form of flow modulation rather than a complete cut-off of water flow, although on/off flow of water is preferred.

FIGS. 1–4 exemplify the invention as described above. FIG. 1 represents portions of a marine engine and exhaust system wherein the engine is cooled by a closed-loop engine coolant system, which typically employs ethylene glycol or other conventionally-known engine coolant liquid.

FIGS. 2 and 3 represent portions of marine engines and exhaust systems as in FIG. 1 wherein an open cooling system cools the marine engine and exhaust system.

Figure 4:
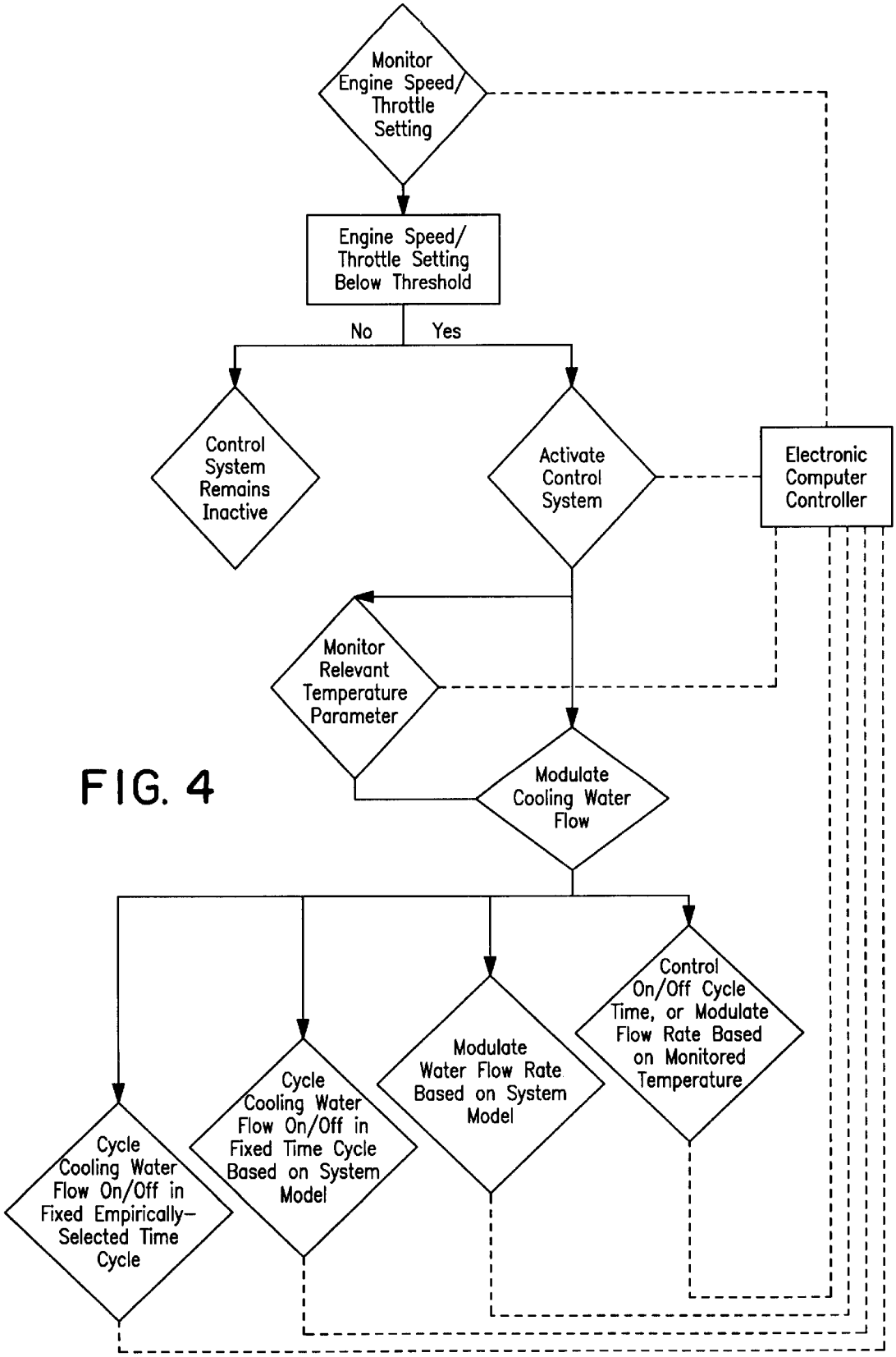
FIG. 4 shows a representative decision diagram illustrating flow of information and decisions in using the control system of the invention.

FIG. 4 is a representative flow chart showing primary decision steps in operation of control systems of the invention.

Specifically addressing FIG. 1, a marine engine 10 has right and left exhaust manifolds 12, which feed into respective exhaust pipes 30. A coolant, e.g. water, pump 14 on the engine circulates e.g. ethylene glycol coolant through the engine block coolant passages, and to, through, and from a heat exchanger 16. Coolant travels to heat exchanger 16 through intake line 18 and travels from heat exchanger 16 back to the water pump through outlet line 20, and thence back to the block. Flow of coolant is illustrated by black arrows 22 superimposed in representative coolant lines.

A sea water pump 24 is mounted on the engine, and is driven by the engine crank shaft. Sea water pump 24 pumps sea water to and through heat exchanger 16 where the sea water absorbs heat from the engine coolant. Flow of sea water in all of the FIGURES is illustrated with white, or hollow arrows 25. Integral with sea water pump 24 is an on/off clutch.

Sea water discharged from the heat exchanger passes through sea water lines 26, to the left and right exhaust manifolds 12. Any excess quantity of sea water in the discharge from the heat exchanger is diverted back to the sea by diverter valve 38, and through diversion lines 40, before the sea water reaches the exhaust manifold. The sea water passes through water jackets in the exhaust manifolds and then passes into the exhaust gas-carrying inner chambers in the exhaust pipes 30 which are mounted to the discharge ends of the exhaust manifolds. The sea water mixes with the exhaust gases in the exhaust pipes, providing cooling to the exhaust gases, sufficient to reduce the temperatures of the exhaust gases enough that the temperatures of the exhaust gases do not damage the temperature-sensitive, e.g. rubber, components of the exhaust system.

Electronic engine control module 32 senses engine speed and temperature, exhaust manifold temperature, and heat exchanger temperature, and issues on/off commands to sea water pump 24, through communication lines 34. In the alternative, control module 32 issues commands to valve 38 to divert excess cooling water as needed, without reducing rate of sea water flow through heat exchanger 16.

Now addressing FIG. 2, marine engine 10 has right and left exhaust manifolds 12, which feed into respective exhaust pipes 30.

Sea water pump 24 is not shown and is mounted away from the engine on the lower unit. The sea water pump is driven by the power transfer shafts which drive the lower unit, off the engine. Sea water pump 24 pumps sea water to and through thermostat 36, thence to engine water pump 14. The water pump pumps the water through the engine block, thus to provide cooling water to the engine.

Water leaving the engine block passes through the second stage of the thermostat, and passes thence through sea water lines 26 to left and right exhaust manifolds 12. The flow of cooling water through sea water lines 26 is regulated by the electronic engine control module at left and right regulating valves 38. Valves 38 can shut off flow of water and/or divert all such water back to sea through diversion lines 40.

The sea water passes through water jackets in the exhaust manifolds and then passes into the exhaust gas-carrying inner chambers in exhaust pipes 30 which are mounted to the discharge ends of the exhaust manifolds. The sea water mixes with the exhaust gases in the exhaust pipes, providing cooling to the exhaust gases, sufficient to reduce the temperatures of the exhaust gases enough that the temperatures of the exhaust gases do not damage the temperature-sensitive, e.g. rubber, components of the exhaust system.

Electronic engine control module 32 senses engine speed and temperature, and/or exhaust manifold temperature, and issues on/off commands, or flow modulation commands, to valves 38, through communication lines 34.

Now addressing FIG. 3, marine engine 10 has right and left exhaust manifolds 12, which feed into respective exhaust pipes 30.

As in FIG. 1, sea water pump 24 is mounted to the engine and is coupled to and driven by the engine crank shaft. Integral with sea water pump 24 is a variable speed clutch. Sea water pump 24 pumps sea water to and through thermostat 36, thence to the water pump. The water pump pumps the water through the engine block, thus to provide cooling water to the engine.

Water leaving the engine block passes through the second stage of the thermostat, and passes thence through sea water lines 26 to left and right exhaust manifolds 12. The flow of cooling water through sea water lines 26 is regulated by the electronic engine control module instructing the variable speed clutch, as well as the control module instructing diverter valves 38.

The sea water passes through water jackets in the exhaust manifolds and then passes into the exhaust gas-carrying inner chambers in exhaust pipes 30 which are mounted to the discharge ends of the exhaust manifolds. The sea water mixes with the exhaust gases in the exhaust pipes, providing cooling to the exhaust gases, sufficient to reduce the temperatures of the exhaust gases enough that the temperatures of the exhaust gases do not damage the temperature-sensitive, e.g. rubber, components of the exhaust system.

Electronic engine control module 32 senses engine speed and temperature, and exhaust manifold temperature, and issues flow rate, namely flow modulation and/or on/off, commands, to the variable speed clutch and valves 38, through communication lines 34.

FIG. 4 generally illustrates the typical decision sequence in use of control systems of the invention. The first step is typically to monitor engine speed. While, as discussed above, engine speed is not always a factor in initiating activation of control systems of the invention, in typical implementation of the invention, engine speed is typically utilized as a first stage decision factor in supplying power to the control system portion of the electronic engine control module or other controller.

An activation speed is typically selected when engine operation is set up. When engine speed is less than the selected activation speed, the control system of the invention is activated. Once the control system is activated, the various input parameters received by the controller are monitored for secondary decision screens which are used by the controller to determine when, and at what time intervals, water flow is to be cycled on and off to the exhaust system, or what degree of modulation is to be implemented in water flowing to the exhaust system. In some cases, modulation produces a reduced rate of water flow, which is coupled with on/off flow of the reduced flow rate water.

The invention can be used with exhaust systems which employ manifolds for gathering the exhaust gases, as well as with exhaust systems which employ individual manifold pipes to gather the exhaust gases from the respective individual cylinders, and then collect the multiple exhaust gas flow streams in an exhaust pipe downstream of the exhaust ports.

As indicated in FIG. 4, the water flow can be cycled on and off in a fixed, empirically-selected time cycle of "x" time on and "y" time off.

In the alternative, and as also indicated in FIG. 4, water flow can be cycled on and off in fixed time cycles, but based on a database model of temperature and water flow rates, at respective engine speeds, employing the combination of the engine and exhaust system of interest.

In a second alternative illustrated in FIG. 4, the water flow rate can be modulated based on the database model of the combination of the engine and exhaust system of interest.

In a third alternative illustrated in FIG. 4, the water flow rate can be cycled on/off, or modulated, based on a monitored temperature, which is representative of, namely models, the temperatures inside the exhaust gas conduits of the exhaust system. In such third alternative, the controller monitors water temperature e.g. in one or both water jackets of the two exhaust manifolds. Desired upper and lower limit temperatures, optionally a target parameter, are stored in the controller. When the sensed temperature reported to the controller reaches the upper or lower limit temperature, or strays a specified distance from the target temperature, the controller instructs the respective actuator, e.g. sea water pump, valve, etc., which makes the desired change in the flow of cooling water to and through the exhaust system. If the exhaust system is approaching the lower end of the desired temperature range, flow of cooling water is reduced or shut off. If the exhaust system is approaching the upper end of the desired temperature range, flow of cooling water is increased or turned on. Similarly, if the temperature of the exhaust system is straying more than a pre-set amount from a target temperature, flow of cooling water is similarly adjusted to reduce or eliminate the variation from the target temperature, as defined in combination with a tolerance window.

FIGS. 1–3 illustrate the engine control module acting as the controller for the control system of the invention. As an alternative, and especially where the control system of the invention is provided as an after-market item, a second, separate system control module 42 is used to perform the functions associated with the control system of the invention. In such instance, and as illustrated in FIG. 3, the second system control module 42, which is provided as part of the control system of the invention, communicates with the engine control module 32 through communication line 44 thereby to receive from the engine control module those needed inputs which are already being received into the engine control module. The system control module 42 communicates with the various components except for engine 10 through communication lines 34. System control module 42 communicates with engine control module 32 through communication line 44. The engine control module communicates with the engine through communication line 46. The system control module 42 of the control system thus operates cooperatively in combination with engine control module 32.

In any of the embodiments of the invention, preferably the default setting for the entire control system is "inactive", namely unpowered. Thus, should the control system fail, the relevant controller automatically shuts off power to the control system. In that state, cooling water flows to the exhaust system at full rated flow.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A control system for use in a marine exhaust system, such marine exhaust system being adapted for connection to an internal combustion marine engine at an inlet end of such marine exhaust system, such internal combustion marine engine having one or more exhaust gas discharge ports, such marine exhaust system comprising one or more exhaust chambers which define an exhaust gas discharge path for conveying exhaust gases from such one or more exhaust gas discharge ports of such internal combustion marine engine to an exit end of such exhaust gas discharge path, such marine exhaust system being designed to use cooling water, flowing through a water jacket, to control temperatures in the exhaust system, along such exhaust gas discharge path, said control system comprising:

(a) sensing apparatus sensing at least one parameter, the at least one parameter being related to accumulation of liquid water in such one or more exhaust chambers proximate such inlet end of such marine exhaust system; and (b) an electrical control receiving, from said sensing apparatus, a signal representing the at least one sensed parameter and, in response to the signal representing a value of such at least one parameter indicating propensity for, or actual, accumulation of liquid water in such one or more exhaust chambers, proximate such inlet end of such marine exhaust system, generating a control response which controls flow of cooling water in a water jacket in such marine exhaust system, sufficient to maintain temperatures, in such marine exhaust system, at such levels as to limit accumulation of liquid water in such one or more exhaust chambers and proximate such exhaust gas discharge ports, from no liquid water to no more liquid water than amounts which are consistent with continued effective operation of both such internal combustion marine engine and such marine exhaust system.

2. A control system as in claim 1, said sensing apparatus being selected from the group consisting of an engine speed sensor, a throttle setting sensor, an engine temperature sensor, a heat exchanger sea water temperature sensor, an engine sea water temperature sensor, an engine coolant temperature sensor, an exhaust gas flow rate sensor, an exhaust manifold temperature sensor, a manifold pipe temperature sensor, and an exhaust water jacket temperature sensor.

3. A control system as in claim 1, said electrical control comprising an engine electronic control module adapted to control general operation of a respective such marine engine.

4. A control system as in claim 1, said electrical control comprising a control module separate and distinct from any electronic engine control module.

5. A control system as in claim 1, controlling flow of cooling water in the water jacket using, as water flow control apparatus, an on/off clutch.

6. A control system as in claim 1, controlling flow of cooling water in the water jacket using, as water flow control apparatus, a variable speed clutch.

7. A control system as in claim 1, controlling flow of cooling water in the water jacket using, as water flow control apparatus, a variable speed sea water pump.

8. A control system as in claim 1, controlling flow of cooling water in the water jacket using, as water flow control apparatus, an on/off valve adapted for use between such engine and such exhaust intake.

9. A control system as in claim 8, further comprising a diversion line out of said on/off valve.

10. A control system as in claim 9, said diversion line by-passing the water jacket, and injecting the water thereby diverted, into the one or more exhaust chambers of the exhaust system, downstream of the water jacket.

11. A control system as in claim 1, controlling flow of cooling water in the water jacket using, as water flow control apparatus, a modulating valve adapted for use between such engine and such exhaust system.

12. A control system as in claim 11, further comprising a diversion line out of said modulating valve.

13. A control system as in claim 12, said diversion line by-passing the water jacket, and injecting the water thereby diverted, into the one or more exhaust chambers of the exhaust system, downstream of the water jacket.

14. A control system as in claim 1, controlling flow of cooling water in the water jacket using, as water flow control apparatus, a flow-controlling clutch adapted for use on such engine, and one or more flow diverter valves adapted for use between such engine and such exhaust system.

15. A control system as in claim 1 wherein said electrical control comprises an electronic controller.

16. A control system as in claim 15, including control structure, optionally included in said electrical control, providing a pre-determined minimum flow of cooling water to such exhaust system, and overriding all other commands of said control system after activation of said control system.

17. A control system as in claim 1, further comprising a database representing modeling of one or more of engine speed, exhaust temperature, and cooling water flow rate in a given combination of such engine and such exhaust system.

18. A marine exhaust system having an inlet end and an exit end, said marine exhaust system being adapted for connecting the inlet end of said marine exhaust system to an internal combustion marine engine at one or more exhaust gas discharge ports of such marine engine, said marine exhaust system comprising (a) exhaust gas conveyance structure comprising one or more exhaust chambers which define an exhaust gas discharge path for conveying exhaust gases from such one or more exhaust gas discharge ports of such internal combustion marine engine to an exit end of the marine exhaust system, the marine exhaust system being designed to use cooling water, flowing through a water jacket, to control temperatures in the exhaust system along the exhaust gas discharge path; and (b) control apparatus for limiting accumulation of liquid water in the one or more exhaust chambers of said exhaust gas conveyance structure proximate such exhaust gas discharge ports of such internal combustion marine engine, said control apparatus comprising:

(i) sensing apparatus sensing at least one parameter, the at least one parameter being related to accumulation of liquid water in the one or more exhaust chambers proximate the inlet end of the marine exhaust system; and (ii) an electrical control receiving, from said sensing apparatus, a signal representing the at least one sensed parameter and, in response to the signal representing a value of such at least one parameter indicating propensity for, or actual, accumulation of liquid water in the one or more exhaust chambers, proximate the inlet end of the marine exhaust system, generating a control response which controls flow of cooling water in the water jacket in the marine exhaust system, sufficient to maintain temperatures, in said marine exhaust system, at such levels as to limit accumulation of liquid water in the one or more exhaust chambers and proximate such exhaust gas discharge ports, from no liquid water to no more liquid water than amounts which are consistent with continued effective operation of both such internal combustion marine engine and said marine exhaust system.

19. A marine exhaust system as in claim 18, said sensing apparatus being selected from the group consisting of an engine speed sensor, a throttle setting sensor, an engine temperature sensor, a heat exchanger sea water temperature sensor, an engine sea water temperature sensor, an engine coolant temperature sensor, an exhaust gas flow rate sensor, an exhaust manifold temperature sensor, a manifold pipe temperature sensor, and an exhaust water jacket temperature sensor.

20. A marine exhaust system as in claim 18, said electrical control comprising an engine electronic control module adapted to control general operation of a respective such marine engine.

21. A marine exhaust system as in claim 18, said electrical control comprising a control module separate and distinct from any electronic engine control module.

22. A marine exhaust system as in claim 18, controlling flow of cooling water in the water jacket using, as water flow control apparatus, an on/off clutch.

23. A marine exhaust system as in claim 18, controlling flow of cooling water in the water jacket using, as water flow control apparatus, a variable speed clutch.

24. A marine exhaust system as in claim 18, controlling flow of cooling water in the water jacket using, as water flow control apparatus, a variable speed sea water pump.

25. A marine exhaust system as in claim 18, controlling flow of cooling water in the water jacket using, as water flow control apparatus, an on/off valve adapted for use between such engine and said exhaust intake.

26. A marine exhaust system as in claim 25, further comprising a diversion line out of said on/off valve.

27. A marine exhaust system as in claim 26, said diversion line by-passing the water jacket, and injecting the water thereby diverted, into the one or more exhaust chambers of the exhaust system, downstream of the water jacket.

28. A marine exhaust system as in claim 18, controlling flow of cooling water in the water jacket using, as water flow control apparatus, a modulating valve adapted for use between such engine and said exhaust system.

29. A marine exhaust system as in claim 28, further comprising a diversion line out of said modulating valve.

30. A marine exhaust system as in claim 29, said diversion line by-passing the water jacket, and injecting the water thereby diverted, into the one or more exhaust chambers of the exhaust system, downstream of the water jacket.

31. A marine exhaust system as in claim 18, controlling flow of cooling water in the water jacket using, as water flow control apparatus, a flow-controlling clutch adapted for use on such engine, and one or more flow diverter valves adapted for use between such engine and said exhaust system.

32. A control system as in claim 18 wherein said electrical control comprises an electronic controller.

33. A marine exhaust system as in claim 18, including control structure, optionally included in said electrical control, providing a pre-determined minimum flow of cooling water to said exhaust system, and overriding all other commands of said control system after activation of said control system.

34. A marine exhaust system as in claim 18, further comprising a database representing modeling of one or more of engine speed, exhaust temperature, and cooling water flow rate in a given combination of such engine and said exhaust system.

35. A marine drive, comprising:

(a) an internal combustion marine engine, having one or more exhaust ports; and (b) a marine exhaust system having an inlet end and an exit end, and being connected, at the inlet end of said marine exhaust system, to said internal combustion marine engine at said one or more exhaust gas discharge ports, said marine exhaust system comprising (i) exhaust gas conveyance structure comprising one or more exhaust chambers which define an exhaust gas discharge path for conveying exhaust gases from the one or more exhaust gas discharge ports of said internal combustion marine engine to an exit end of the marine exhaust system, said marine exhaust system being designed to use cooling water, flowing through a water jacket, to control temperatures in the exhaust system along the exhaust gas discharge path; and (ii) control apparatus for limiting accumulation of liquid water in the one or more exhaust chambers of said exhaust gas conveyance structure proximate said exhaust gas discharge ports of said internal combustion marine engine, said control apparatus comprising:

(A) sensing apparatus sensing at least one parameter, the at least one parameter being related to accumulation of liquid water in the one or more exhaust chambers proximate the inlet end of said marine exhaust system, and (B) an electrical control receiving, from said sensing apparatus, a signal representing the at least one sensed parameter and, in response to the signal representing a value of the at least one parameter indicating propensity for, or actual, accumulation of liquid water in the one or more exhaust chambers, proximate the inlet end of said marine exhaust system, generating a control response which controls flow of cooling water in the water jacket in said marine exhaust system, sufficient to maintain temperatures, in said marine exhaust system, at such levels as to limit accumulation of liquid water in the one or more exhaust chambers and proximate said exhaust gas discharge ports, from no liquid water to no more liquid water than amounts which are consistent with continued effective operation of both said internal combustion marine engine and said marine exhaust system.

36. A marine drive as in claim 35, said sensing apparatus being selected from the group consisting of an engine speed sensor, a throttle setting sensor, an engine temperature sensor, a heat exchanger sea water temperature sensor, an engine sea water temperature sensor, an engine coolant temperature sensor, an exhaust gas flow rate sensor, an exhaust manifold temperature sensor, a manifold pipe temperature sensor, and an exhaust water jacket temperature sensor.

37. A marine drive as in claim 35, said electrical control comprising an engine electronic control module adapted to control general operation of said marine engine.

38. A marine drive as in claim 35, said electrical control comprising a control module separate and distinct from any electronic engine control module on said engine.

39. A marine drive as in claim 35, controlling flow of cooling water in the water jacket using, as water flow control apparatus, an on/off clutch.

40. A marine drive as in claim 35, controlling flow of cooling water in the water jacket using, as water flow control apparatus, a variable speed clutch.

41. A marine drive as in claim 35, controlling flow of cooling water in the water jacket using, as water flow control apparatus, a variable speed sea water pump.

42. A marine drive as in claim 35, controlling flow of cooling water in the water jacket using, as water flow control apparatus, an on/off valve between said engine and said exhaust intake.

43. A marine drive as in claim 42, further comprising a diversion line out of said on/off valve.

44. A marine drive as in claim 43, said diversion line by-passing the water jacket, and injecting the water thereby diverted, into the one or more exhaust chambers of the exhaust system, downstream of the water jacket.

45. A marine drive as in claim 35, controlling flow of cooling water in the water jacket using, as water flow control apparatus, a modulating valve between said engine and said exhaust system.

46. A marine drive as in claim 45, further comprising a diversion line out of said modulating valve.

47. A marine drive as in claim 46, said diversion line by-passing the water jacket, and injecting the water thereby diverted, into the one or more exhaust chambers of the exhaust system, downstream of the water jacket.

48. A marine drive as in claim 35, controlling flow of cooling water in the water jacket using, as water flow control apparatus, a flow-controlling clutch on said engine, and one or more flow diverter valves between said engine and said exhaust system.

49. A marine drive as in claim 35 wherein said electrical control comprises an electronic controller.

50. A marine drive as in claim 35, including control structure, optionally included in said electrical control, providing a pre-determined minimum flow of cooling water to said exhaust system, and overriding all other commands of said control system after activation of said control system.

51. A marine drive as in claim 35, further comprising a database representing modeling of one or more of engine speed, exhaust temperature, and cooling water flow rate in a given combination of such engine with said exhaust system.

52. In a marine exhaust system, the marine exhaust system being adapted for connection to an internal combustion marine engine at an inlet end of the marine exhaust system, such internal combustion marine engine having one or more exhaust gas discharge ports, the marine exhaust system comprising one or more exhaust chambers which define an exhaust gas discharge path for conveying exhaust gases from such one or more exhaust gas discharge ports of such internal combustion marine engine to an exit end of the exhaust gas discharge path, the marine exhaust system being designed to use cooling water, flowing through a water jacket, to control temperatures in the exhaust system, along the exhaust gas discharge path, a method of limiting accumulation of liquid water in the one or more exhaust chambers proximate such exhaust gas discharge ports of such internal combustion marine engine, the method comprising activating a control system, comprising:

(a) sensing at least one parameter using sensor apparatus, the at least one parameter being related to accumulation of liquid water in the one or more exhaust chambers proximate the inlet end of the marine exhaust system; and (b) sending a signal from the sensor apparatus to an electrical control which generates a control response which controls flow of cooling water in the water jacket in the marine exhaust system, sufficient to maintain temperatures in the exhaust system at such levels as to limit accumulation of liquid water in the one or more exhaust chambers and proximate such exhaust gas discharge ports, from no liquid water to no more liquid water than amounts which are consistent with continued effective operation of both such internal combustion marine engine and the marine exhaust system.

53. A method as in claim 52, the sensing of at least one parameter comprising sensing at least one of engine speed, throttle setting, engine temperature, heat exchanger sea water temperature, engine sea water temperature, engine coolant temperature, exhaust gas flow rate, exhaust manifold temperature, manifold pipe temperature, and exhaust water jacket temperature.

54. A method as in claim 52, further comprising controlling flow of cooling water only when engine speed is at or below a critical upper threshold engine speed.

55. A method as in claim 52, further comprising controlling flow of cooling water only when engine speed is at or below a selected engine speed substantially below full rated power output of the respective engine.

56. A method as in claim 52, including controlling flow of cooling water by intermittently shutting completely off flow of cooling water to the exhaust system, and subsequently turning flow of cooling water back on.

57. A method as in claim 52, including controlling flow of cooling water by intermittently shutting completely off flow of cooling water to the exhaust system, and subsequently turning flow of cooling water back on, by turning off, and then back on a clutch connected to a sea water pump associated with the marine engine.

58. A method as in claim 56, including also modulating rate of flow of cooling water when water flow is turned on, to a rate less than full rated flow.

59. A method as in claim 52, including controlling flow of cooling water to the marine exhaust system by modulating flow of cooling water to the exhaust system to less than a full rated flow.

60. A method as in claim 54, including controlling flow of cooling water to the marine exhaust system by turning water flow off, and subsequently on, in cycles, according to a pre-set timing sequence.

61. A method as in claim 52, including intermittently turning off, and subsequently back on, flow of cooling water using a valve between the engine and the exhaust system.

62. A method as in claim 52, including modulating flow of cooling water to the exhaust system using a modulating valve between the engine and the exhaust system.

63. A method as in claim 52, including monitoring engine speed, modulating flow of cooling water to the exhaust system above a pre-determined engine speed, and when the engine is operating below the pre-determined speed, intermittently turning off flow of cooling water and subsequently turning flow of cooling water back on, in cycles.

64. A method as in claim 52, including sensing an exhaust system temperature and, irrespective of engine speed, and based only on such sensed temperature, controlling flow of cooling water to the exhaust system in accord with pre-selected trigger water temperatures, or in accord with a target water temperature in combination with a temperature tolerance range.

65. A method as in claim 52, including sensing an exhaust system temperature, and controlling flow of cooling water to the exhaust system in accord with pre-selected trigger water temperatures, or in accord with a target water temperature in combination with a temperature tolerance range.

66. A method as in claim 65, including also sensing engine speed, and implementing the control of cooling water to the exhaust system only when the engine speed is below a predetermined threshold engine speed.

67. A method as in claim 52, including providing a pre-determined minimum flow of cooling water to the exhaust system, overriding all other commands of the control system any time the control system is activated.

68. A method as in claim 52, the engine including an electronic control module, the method including providing, as the electrical control, an electronic system control module, separate and distinct from the engine electronic control module, the system control module communicating with the engine electronic control module.

69. A method as in claim 52, including modeling a combination of engine and exhaust, thereby collecting temperature response data representative of exhaust system temperature at various engine speeds, as related to time at the respective speeds, and controlling flow of cooling water to the exhaust system at least in part based on the data in a database which is representative of the respective engine and exhaust.

* * * * *